US007021187B1

(12) United States Patent
Grassi

(10) Patent No.: US 7,021,187 B1
(45) Date of Patent: Apr. 4, 2006

(54) LOW VELOCITY AIR BURST MUNITION AND LAUNCHER SYSTEM IMPLEMENTED ON AN EXISTING WEAPON

(75) Inventor: James Grassi, Rockaway, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 97 days.

(21) Appl. No.: 10/708,772

(22) Filed: Mar. 24, 2004

(51) Int. Cl.
*F42C 17/04* (2006.01)

(52) U.S. Cl. ..... 89/6.5

(58) Field of Classification Search ..... 89/6, 89/6.5, 1.811; 42/105
See application file for complete search history.

(56) References Cited

U.S. PATENT DOCUMENTS 3,760,732 A * 9/1973 Schuster et al. ..... 102/215
3,777,665 A * 12/1973 Ziemba ..... 102/215
4,005,631 A * 2/1977 Kaiser et al. ..... 89/6.5
4,494,198 A * 1/1985 Smith et al. ..... 89/132
4,531,052 A * 7/1985 Moore ..... 235/404
4,736,681 A * 4/1988 Hall et al. ..... 102/215
5,001,962 A * 3/1991 Schlegel et al. ..... 89/6.5
5,024,136 A * 6/1991 Bock ..... 89/6
5,343,795 A * 9/1994 Ziemba et al. ..... 89/6.5
5,497,704 A * 3/1996 Kurschner et al. ..... 102/264
5,831,718 A * 11/1998 Desai et al. ..... 356/5.01

* cited by examiner

*Primary Examiner*—Stephen M. Johnson
(74) *Attorney, Agent, or Firm*—Michael C Sachs; John F. Moran

(57) ABSTRACT

A low velocity air burst munition and launcher system allows the user to program the munition to detonate in the air at a specified range from the muzzle. The system further allows the munition to detonate upon impact or self-destruct if the target is missed. The system allows the user to program and reset the munition multiple times, and allows the user to perform this operation at night in cold weather conditions. The system requires the user to manually input the range into a fuze programming device prior to projectile launch. The fuze programming device is capable of direct interface with electronic range determining devices. The system employs electrical contacts in the chamber of the munition launcher barrel and on the projectile body to complete the circuit used for programming. Furthermore, this system is capable of integrating a magnetic induction method of programming.

18 Claims, 6 Drawing Sheets

LOW VELOCITY AIR BURST MUNITION AND LAUNCHER SYSTEM IMPLEMENTED ON AN EXISTING WEAPON

FEDERAL RESEARCH STATEMENT

The inventions described herein may be manufactured, used and licensed by or for the U.S. Government for U.S. Government purposes.

BACKGROUND OF INVENTION

1. Field of the Invention

The present invention generally relates to munitions and more specifically pertains to air burst ammunition. In particular, the present invention relates to extending to an existing weapon capability of launching a low velocity air burst munition with manual range input.

2. Background of the Invention

An exemplary conventional point detonating munition is a 40 mm low velocity grenade tactical round such as, for example, the M433 High Explosive Dual Purpose (HEDP) cartridge. The M433 HEDP is a dual purpose projectile (fragmenting and shaped charge penetrator) with a point detonating fuze. The M433 HEDP is fired predominantly from the M203 grenade launcher, a single-shot breech-loading weapon that is mounted below the M-16/M-4 combat rifle. This weapon configuration is the current system carried by the U.S. infantry soldier. Although this technology has proven to be useful, it would be desirable to present additional improvements. For example, enemy troops that fight from behind barriers, in fox holes or through a window in a room several stories high are difficult to neutralize with conventional point detonating munitions.

An approach to neutralizing enemy troops in difficult to neutralize locations utilizes air burst munitions. Air burst munitions are programmed by the user to detonate in midair in locations such as, for example, behind a barrier, above a fox hole, or in the middle of a room several stories high. A future replacement for the M433 HEDP utilizing air burst capability is the Objective Individual Combat Weapon (XM-29). The XM-29 embodies an integrated kinetic energy and air burst capability as well as a fire control system capable of determining range to target and air burst fuze programming.

However, the XM-29 will not be available for widespread use for several years. What is needed is a method for applying air-bursting technology to the current 40 mm low velocity grenade and launcher system in a simplified and cost effective manner. The need for such a system has heretofore remained unsatisfied.

SUMMARY OF INVENTION

The present invention satisfies this need, and presents a low velocity air burst munition and launcher system (collectively referred to herein as "the system" or "the present system"). The present system upgrades the current M203/M4 weapon system with air burst technology, allowing military personnel to become accustomed to and proficient in the use of air burst munitions. The present system thus eases the transition for personnel to future systems utilizing air burst munitions such as, for example, the XM-29. Further, the present system is both simple and cost effective, allowing use by the military reserves, thus offsetting the technological training gap of the military reserves with respect to the enlisted soldier.

The present system comprises a low velocity air burst munition, a fuze setter, and a single-shot, breech-loading, low velocity munition launcher. A soldier predetermines the range of the low velocity air burst munition either by visual estimation or a separate ranging device (i.e., parallax lens or laser range finder). The soldier enters the range setting into the fuze setter and then launches the low velocity air burst munition. If no range setting is entered, the low velocity air burst munition operates with the default setting at point detonation. Regardless of the pre-launch detonation mode, the low velocity air burst munition is capable of self-destruction to avoid the dispersal of unexploded ordnance on the battlefield or training ground.

The fuze setter is a small electronic device mountable to the weapon and powered by conventional, commercially available batteries. The fuze setter is capable of manipulation by either the left or right hand while outfitted with cold weather gloves. The fuze setter comprises a display that is viewable during the day or night and is compatible with night vision systems. The fuze may be programmed and reset numerous times, allowing the soldier to compensate for changing situations.

In an embodiment of the present system, a range finding device is hardwired to the fuze setter, providing automatic entry of detonation range. In a further embodiment, the fuze setter employs an interface connector/plug allowing the use of the range finding device as a peripheral accessory.

The low velocity air burst munition is chambered into the munition launcher prior to programming. In yet another embodiment, electrical contacts in the chamber of the barrel and on the projectile complete an electrical circuit used for data transfer during programming of the range of the low velocity air burst munition. Advantages of using electrical contacts to form an electrical circuit for data transfer are simplicity in design, reduced overall power consumption, and low cost. In a further embodiment, the fuze may be programmed via magnetic induction.

BRIEF DESCRIPTION OF DRAWINGS

The various features of the present invention and the manner of attaining them will be described in greater detail with reference to the following description, claims, and drawings, wherein reference numerals are reused, where appropriate, to indicate a correspondence between the referenced items, and wherein:

DETAILED DESCRIPTION

Figure 1:
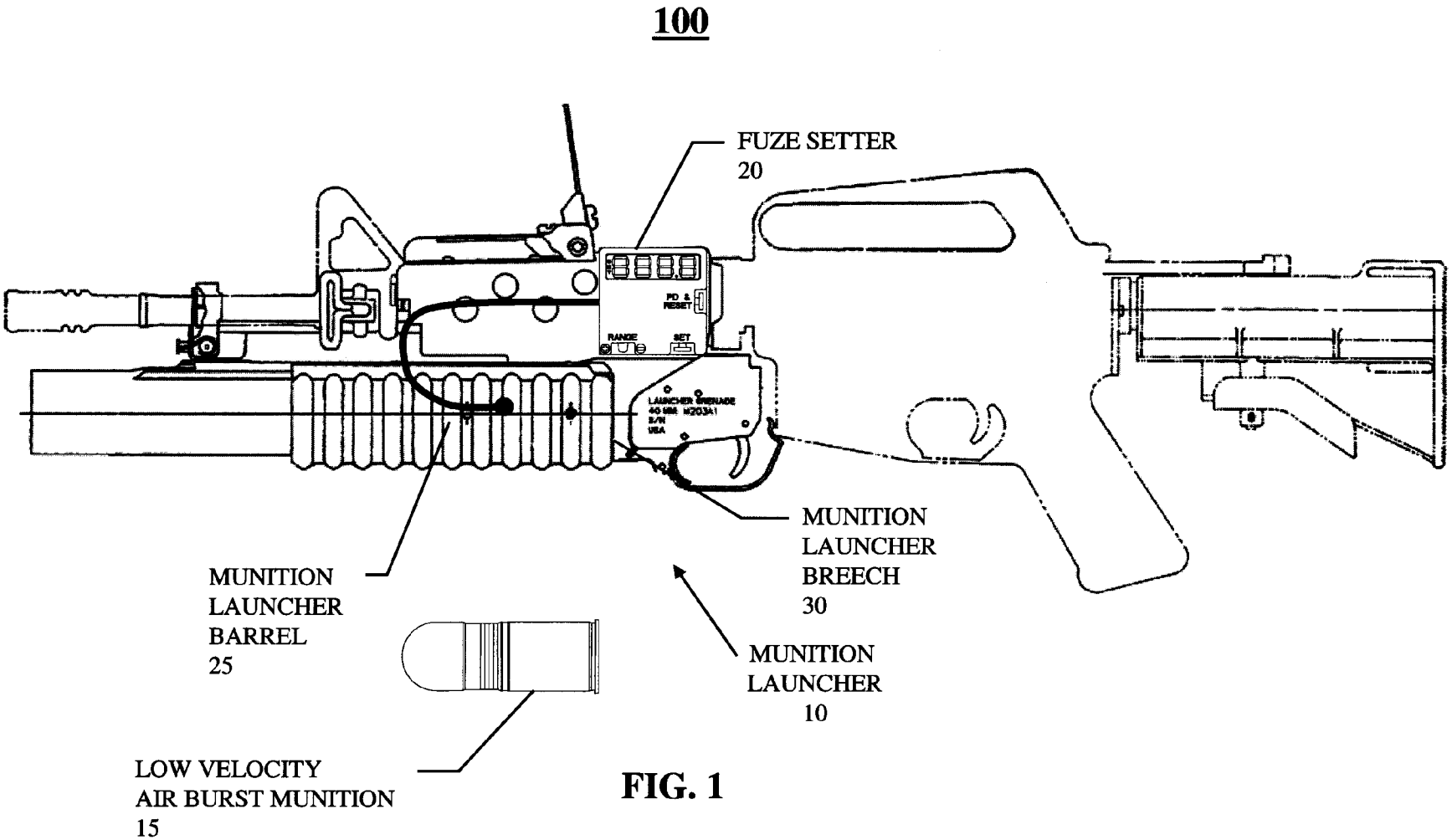
FIG. 1 is a perspective view of an exemplary weapon in which a low velocity air burst munition and launcher may be used.

FIG. 1 illustrates an exemplary weapon 100 comprising a munition launcher 10 that launches a low velocity air burst munition 15. The munition launcher 10 propels the low velocity air burst munition 15 to a desired target area where the low velocity air burst munition 15 explodes in the air.

The munition launcher 10 comprises a fuze setter 20, a munition launcher barrel 25, and a munition launcher breech 30. The low velocity air burst munition 15 operates in a point-detonation mode, an air burst mode, or a post-launch self-destruct mode. The low velocity air burst munition 15 is set by default for point-detonation mode and is programmed for air-bursting mode using the fuze setter 20.

To program the fuze of the low velocity air burst munition 15 for air-burst mode, a user determines an air burst setting based on the range at which detonation of the low velocity air burst munition 15 is desired. The user then enters the air burst setting into the fuze setter 20. A point-detonation signal resulting from the low velocity air burst munition 15 impacting a stiff obstacle overrides the air burst setting of the low velocity air burst munition 15.

The self-destruct mode of the low velocity air burst munition 15 is activated when the fuze is armed. The self-destruct mode then functions when a predetermined maximum time of flight is exceeded. The predetermined maximum time of flight is determined as the maximum range of the munition plus an added safety margin. For example, if six seconds are required to reach a maximum range, the predetermined maximum time of flight can be arbitrarily set at ten seconds. In this example, the low velocity air burst munition 15 self-destructs if the low velocity air burst munition 15 has not been otherwise detonated in ten seconds.

Figure 2:
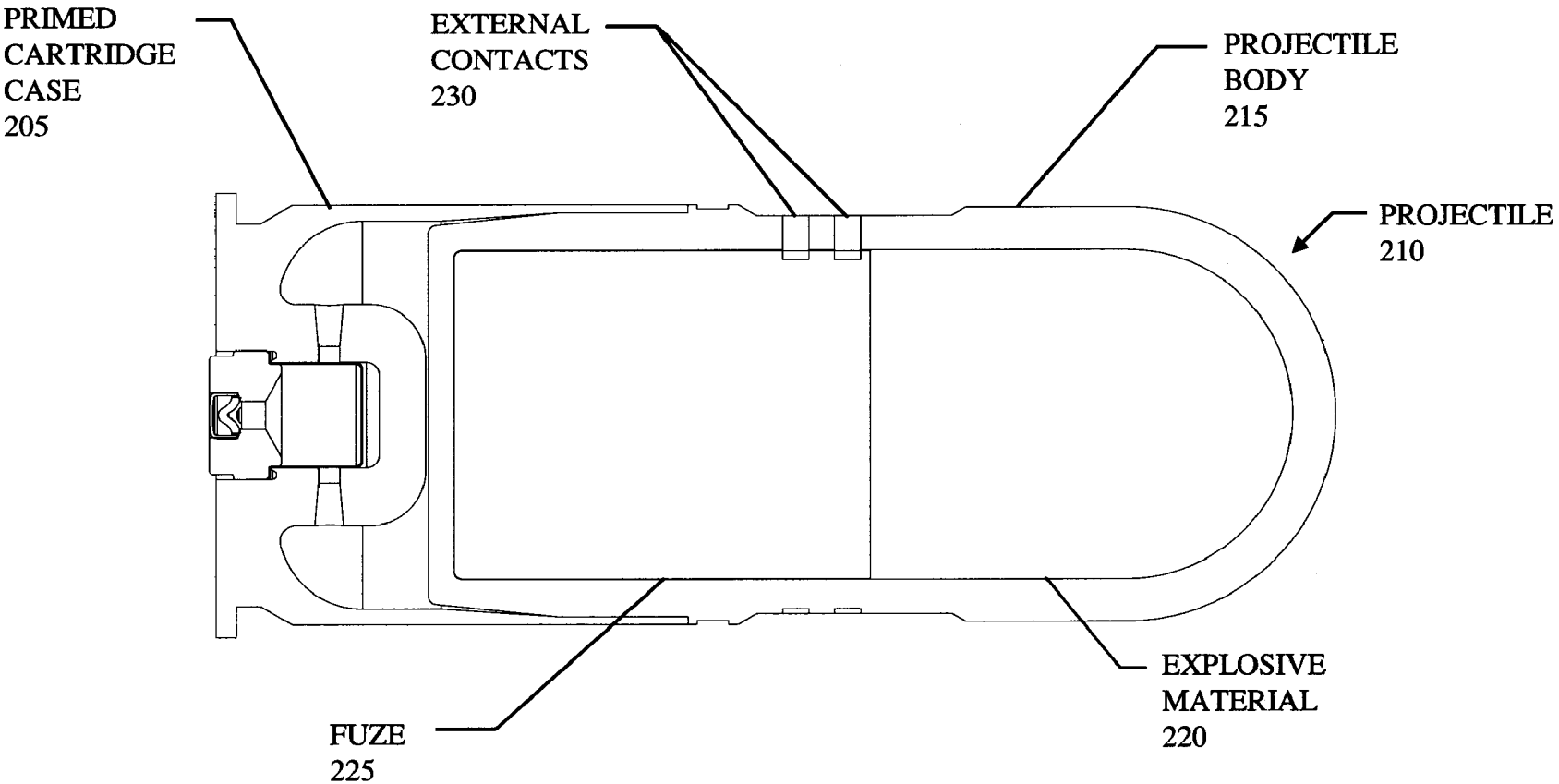
FIG. 2 is a cross-section view of the low velocity air burst munition of FIG. 1 showing a primed cartridge case, a projectile body, external contacts, a fuze assembly, and an explosive material.

FIG. 2 is a cross-section view of an exemplary low velocity air burst munition 15 comprising a conventional 40 mm×46 mm NATO primed cartridge case 205 (also referenced herein as primed cartridge case 205) and a 40 mm low velocity air burst projectile 210 (also referenced herein as projectile 210). The projectile 210 comprises a projectile body 215, an explosive material 220, a fuze 225 and external contacts 230 for fuze programming.

The fuze 225 receives an input of the air burst setting (measurable in meters or yards) from the user; the fuze 225 converts the air burst setting into a time of flight. The time of flight is determined from the exterior ballistic performance of the projectile 210 that is permanently programmed into the fuze 225. An output of the fuze 225 is elapsed flight time. When the low velocity air burst munition 15 is operating in air burst mode, the elapsed flight time triggers the fuze 225 to detonate the explosive material 220 by counting up from zero to the time of flight. In an embodiment, the elapsed flight time triggers the fuze 225 to detonate the explosive material 220 by counting down from the time of flight to zero.

Striking a stiff obstacle prior to reaching the time of flight output value triggers the fuze 225 to detonate the explosive material 220 [point-detonation mode]. If the projectile 210 does not receive input of the air burst setting at the time of launch, the fuze 225 defaults to the point-detonation mode. If the projectile 210 does not strike an object after the predetermined maximum time of flight has elapsed, the fuze 225 detonates the explosive material 220.

Figure 3:
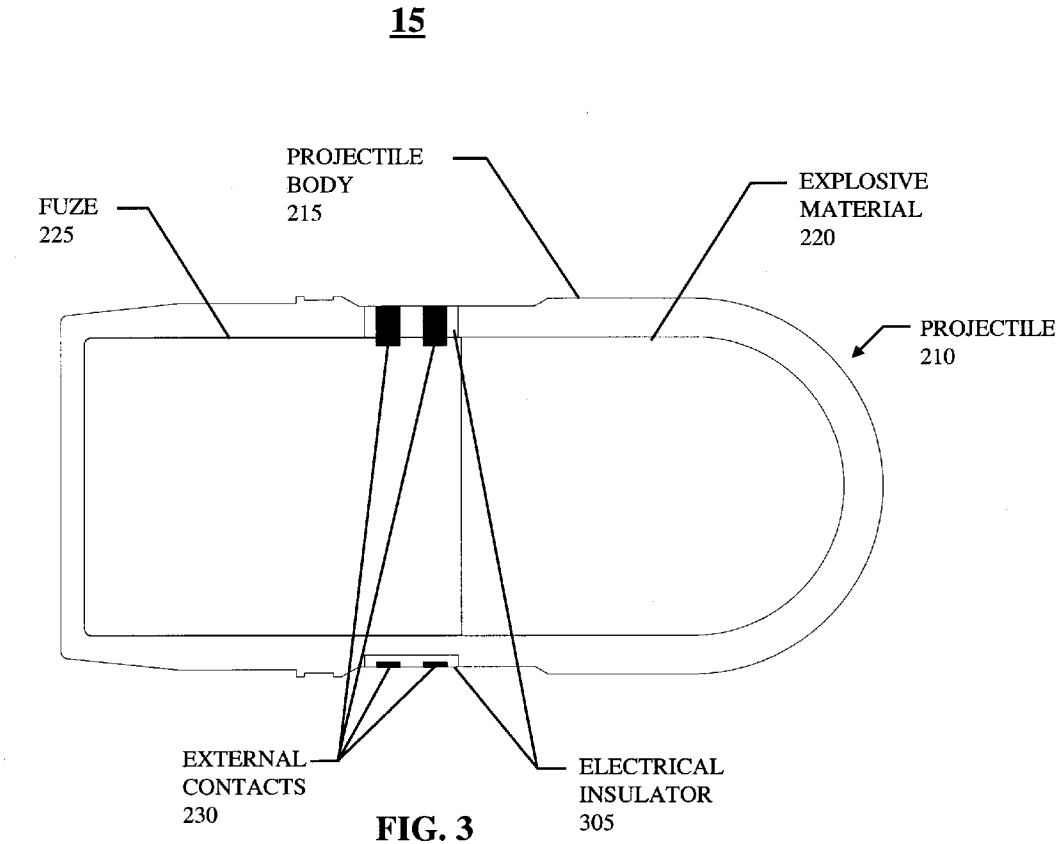
FIG. 3 is a cross-section view of the low velocity air burst munition of FIG. 1 illustrating external electrical contacts for connecting with a fuze setter.
Figure 4:
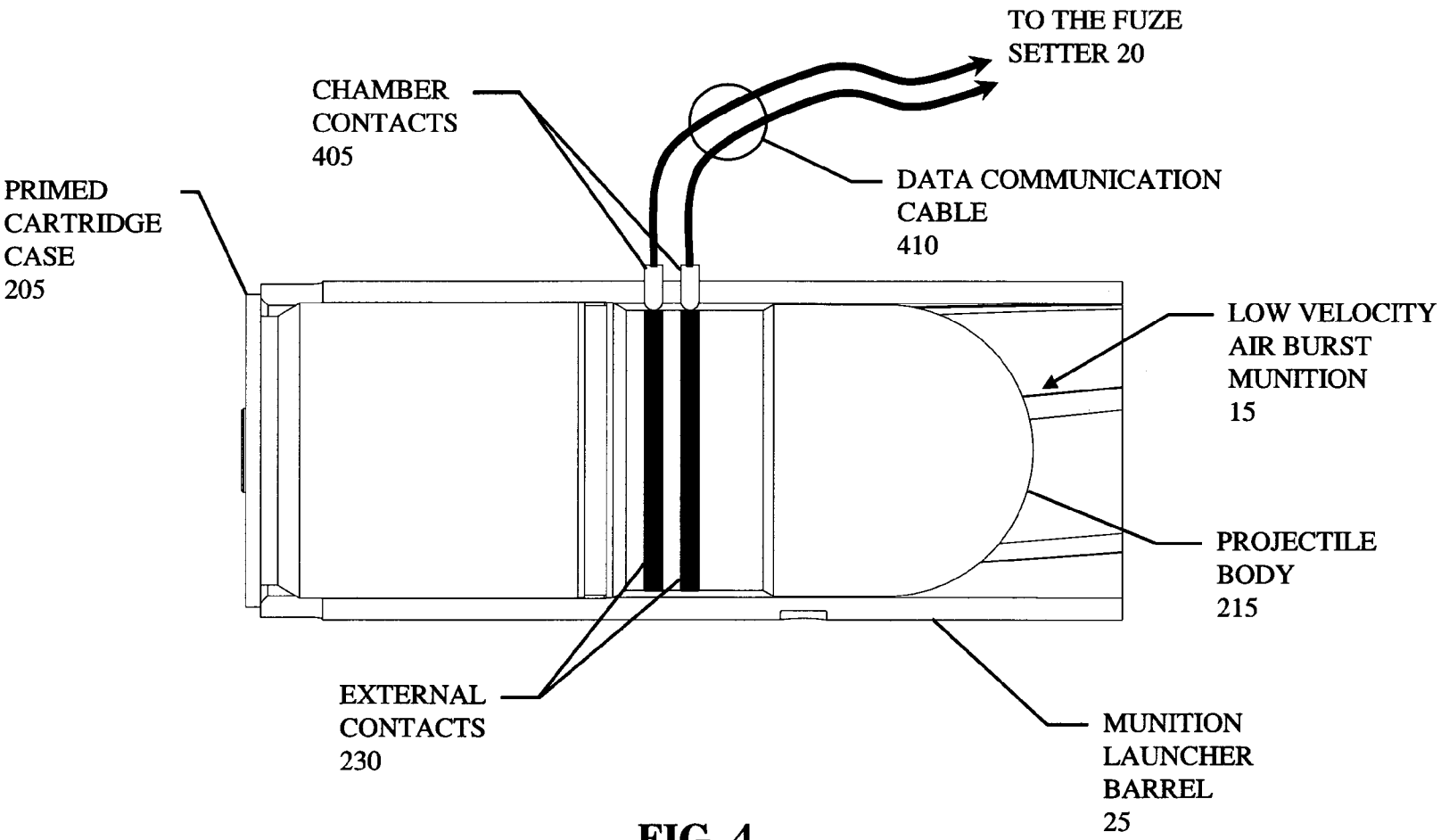
FIG. 4 is a cross-section view of the low velocity air burst munition and launcher of FIG. 1 illustrating placement of the low velocity air burst munition within the launcher for making electrical contact with the fuze setter.

FIGS. 3 and 4 illustrate a method by which a circuit is completed between the fuze setter 20 and the fuze 225. The external contacts 230 on the projectile body 215 comprise annular rings of conductive metal separated by an electrical insulator 305 comprised of electrical insulator material. As illustrated in FIG. 4, contact between the external contacts 230 on the projectile body 215 and chamber contacts 405 in the munition launcher barrel 25 occurs when the low velocity air burst munition 15 is chambered in the munition launcher barrel 25 (FIG. 4). The chamber contacts 405 connect to the fuze setter 20 via a data communication cable 410. The external contacts 230 on the projectile body 215 connect to the fuze 225 (FIGS. 2 and 3).

A contact between the external contacts 230 on the projectile body 215 and the chamber contacts 405, completes a circuit between the fuze setter 20 and the fuze 225. The completed circuit allows transmission of the air burst setting from the fuze setter 20 to the fuze 225. In an embodiment, the circuit between the fuze setter 20 and fuze 225 is completed through magnetic induction.

Figure 5:
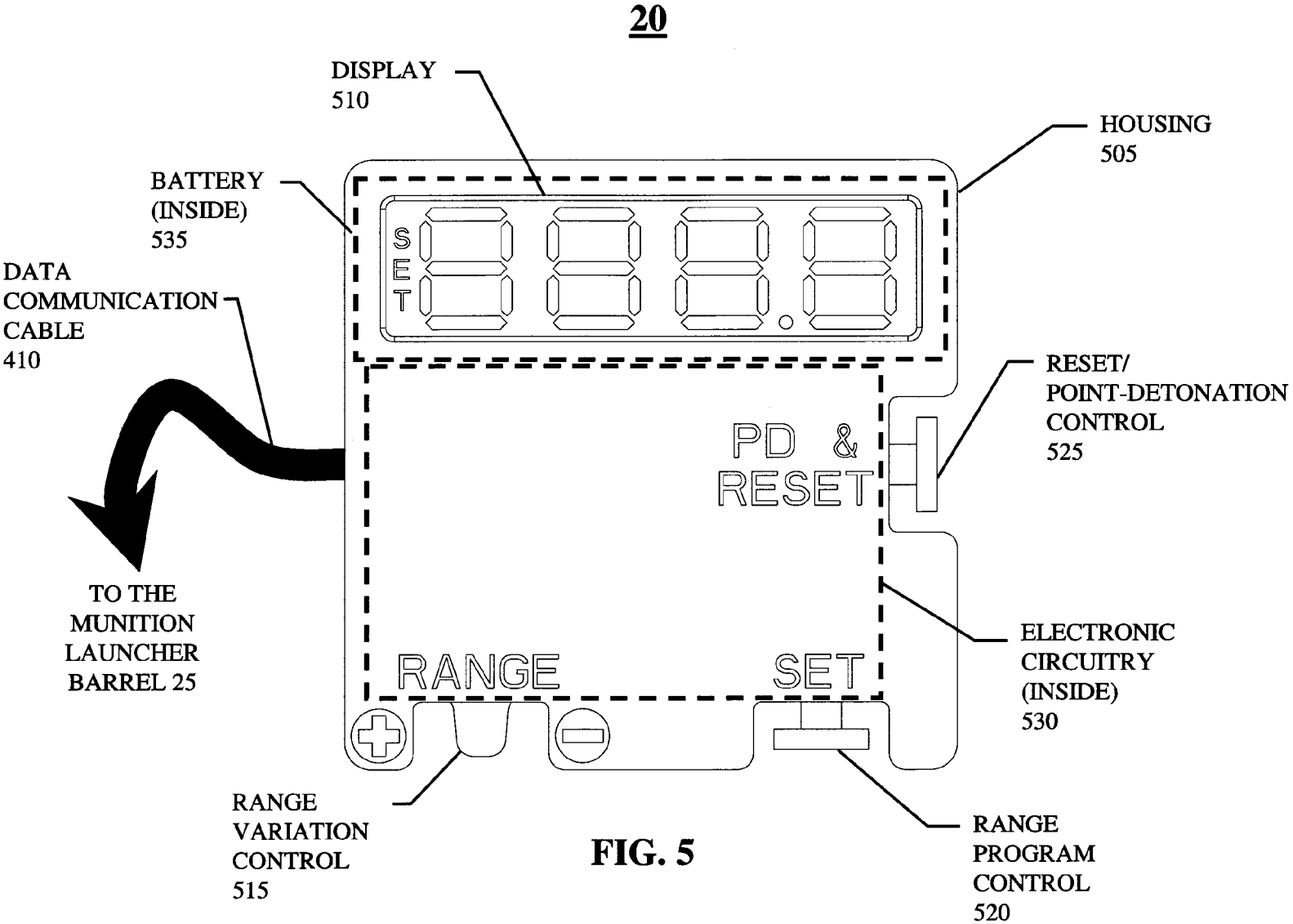
FIG. 5 is a perspective drawing of the fuze setter of the low velocity air burst munition and launcher of FIG. 1.

The diagram of FIG. 5 illustrates an exemplary model of the fuze setter 20 with dashed lines indicating components housed inside the fuze setter 20. The fuze setter 20 comprises a housing 505, a display 510, a range variation control 515, a range program control 520, a reset/point-detonation control 525, electronic circuitry 530, a battery 535, and a data communication cable 410. The display 510 is digital, employing four numerals; the right most digit represents the one-tenth decimal place. The display 510 further indicates when the range value has been set.

The range variation control 515 may be any type of switch that can be used to enter values into the fuze setter 20. In an embodiment, the range variation control 515 is a rocker switch that pivots from increasing range (denoted by a "plus" symbol) to decreasing range (denoted by a "minus" symbol). In a further embodiment, use of the range variation control 515 "wakes up" the fuze setter 20, resulting in power being applied to the display 510. In yet another embodiment, the range is input to the fuze setter 20 by an electronic range-determining device.

The range program control 520 may take the form of a push button and is depressed to program the fuze 225 with the range value shown on the display 510. The reset/point-detonation control 525 may also take the form of a push button and is depressed to reset the fuze 225 to the default point-detonation mode. If held for a prolong period of time (approximately 5 seconds), the reset/point-detonation control 525 can instruct the electronic circuitry 530 of the fuze setter 20 to turn off power to the display 510. The battery 535 powers the fuze setter 20. The battery 535 can be a conventional commercially available battery such as, for example, a AA alkaline, a AAA alkaline, or a 3 volt lithium.

Figures 6A, 6B:
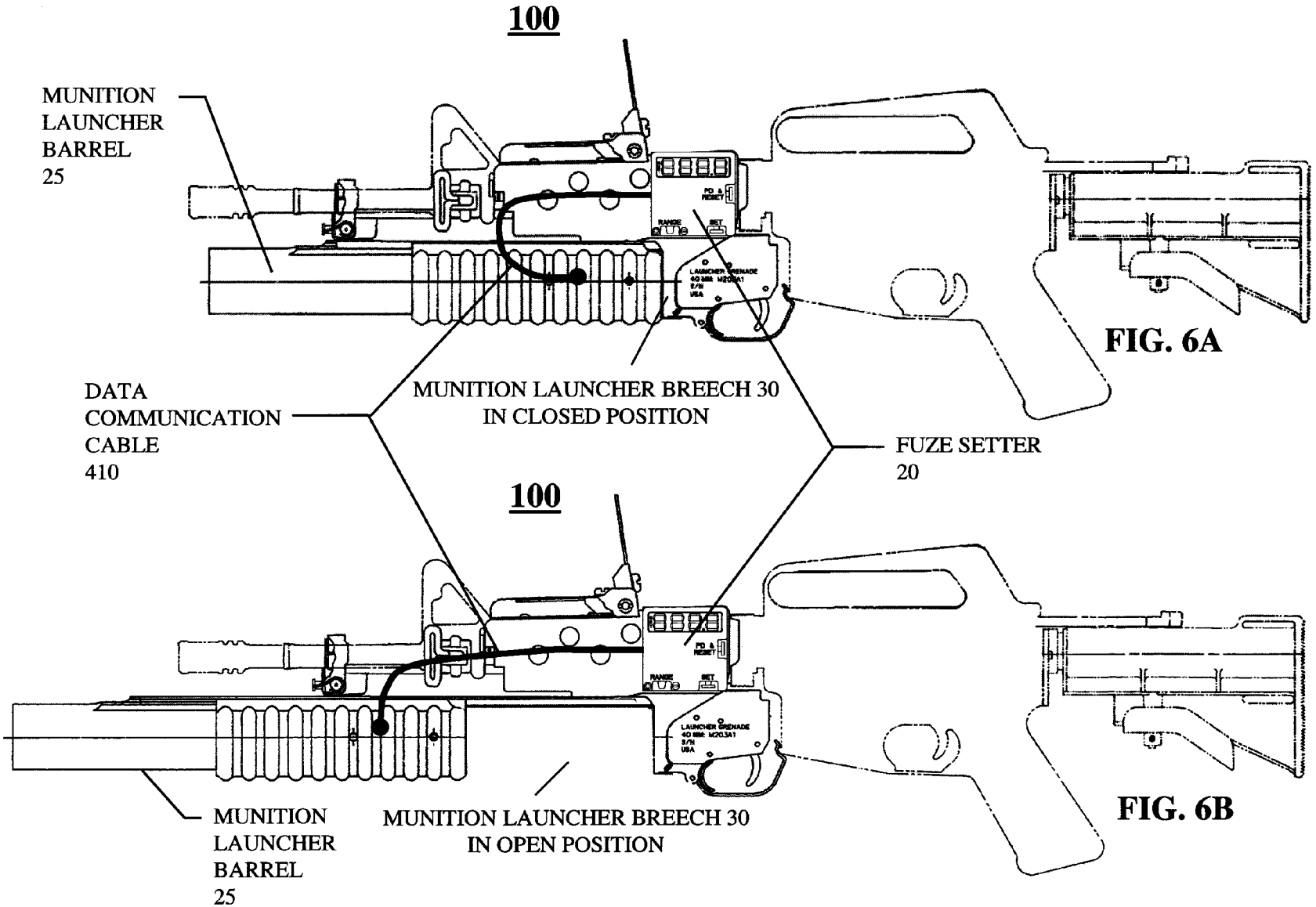
FIG. 6 is comprised of FIGS. 6A and 6B and represents a perspective drawing of the low velocity air burst munition and launcher of FIG. 1 illustrating a closed and open position of the munition launcher.

The data communication cable 410 connects the fuze setter 20 to the chamber contacts 405. As illustrated by FIG. 6 (FIGS. 6A and 6B), the data communication cable 410 is long enough to allow the munition launcher barrel 25 to slide from the fully closed position (FIG. 6A) to the fully open position (FIG. 6B). In a further embodiment, the flexibility and length of the data communication cable 410 allows for attachment to a munition launcher barrel 25 that opens and closes in a manner other than sliding.

It is to be understood that the specific embodiments of the invention that have been described are merely illustrative of certain applications of the principle of the present invention. Numerous modifications may be made to the low velocity air burst munition and launcher system implemented on an existing weapon described herein without departing from the spirit and scope of the present invention.

What is claimed is:

1. A system for use with a weapon for munition launching, comprising:

a fuze for detonation of a munition that is located on a movable component of the weapon that moves upon munition launching;

a fuze setter located on a non-movable component of the weapon that does not move significantly upon munition launching, for setting a range a which the fuze detonates the munition;

a flexible data communication cable connecting the fuze setter and the fuze;

wherein the data communication cable transmits detonation control data from the fuze setter to the fuze; and wherein the data communication cable flexes in compliance with the movable component of the weapon upon launching of the munition.

2. The system of claim 1, wherein the fuze setter comprises a display for displaying the range at which the fuze is triggered.

3. The system of claim 2, wherein the display is viewable in daylight.

4. The system of claim 2, wherein the display is viewable at night.

5. The system of claim 4, wherein the display is viewable by a user wearing a night vision device.

6. The system of claim 1, wherein the fuze comprises a means by which the range is manually entered by a user into the fuze setter.

7. The system of claim 6, wherein the means by which the range is manually entered is manipulable by a user wearing gloves.

8. The system of claim 1, wherein the fuze is triggered upon impact with a stiff obstacle, detonating the munition.

9. The system of claim 1, wherein the fuze is triggered after a predetermined time delay that is in excess of a flight time has elapsed, detonating the munition.

10. The system of claim 1, wherein the range is transmitted from the fuze setter to the munition by means of magnetic induction.

11. The system of claim 1, wherein the fuze detonates the explosive material by counting up from a zero time to a flight time.

12. The system of claim 1, wherein the fuze detonates the explosive material by counting down from a flight time to zero.

13. The system of claim 1, wherein the fuze setter comprises a battery for supplying power to the fuze setter.

14. The system of claim 1, wherein the movable component of the weapon comprises a munition launcher.

15. The system of claim 14, wherein the non-movable component of the weapon comprises a weapon barrel.

16. The system of claim 15, wherein the munition in the munition launcher comprises a plurality of external electrical contacts for electrically connecting the fuze to the fuze setter.

17. The system of claim 16, wherein the munition launcher comprises a plurality of chamber contacts for electrically connecting external electrical contacts to the fuze setter.

18. The system of claim 16, wherein the plurality of chamber contacts in the munition launcher are electrically connected to the fuze setter via the data communication cable.

* * * * *